US006243934B1

(12) United States Patent
Wadzinski

(10) Patent No.: US 6,243,934 B1
(45) Date of Patent: Jun. 12, 2001

(54) PAPER POLISHING BELT AND METHOD OF POLISHING PAPER

(75) Inventor: Michael Wadzinski, Menasha, WI (US)

(73) Assignee: Appleton Coated, LLC, Appleton, WI (US)

( * ) Notice: Subject to any disclaimer, the term of this patent is extended or adjusted under 35 U.S.C. 154(b) by 0 days.

(21) Appl. No.: 08/478,446

(22) Filed: Jun. 7, 1995

Related U.S. Application Data

(63) Continuation-in-part of application No. 08/263,199, filed on Jun. 21, 1994, now Pat. No. 5,533,244.

(51) Int. Cl.[7] ..... B24B 39/00; B24B 21/00

(52) U.S. Cl. ..... 29/90.1; 451/296; 451/532

(58) Field of Search ..... 427/361, 362; 162/109, 117, 361, 362; 451/296, 526, 536, 532; 428/323, 399, 357, 372, 378, 375, 397; 442/181; 51/295; 29/90.1

(56) References Cited

U.S. PATENT DOCUMENTS

| | | | | |
|---|---|---|---|---|
| Re. 21,852 | * | 7/1941 | Anderson | 451/536 |
| 56,457 | | 7/1866 | Shepherd et al. . | |
| 1,842,848 | | 1/1932 | Steffen . | |
| 1,961,911 | * | 6/1934 | Pusch | 451/536 |
| 1,970,227 | | 8/1934 | Frisbie . | |
| 2,060,664 | * | 11/1936 | Cohn . | |
| 2,123,581 | * | 7/1938 | Anderson | 451/536 |
| 2,200,946 | * | 5/1940 | Bloch . | |
| 2,284,738 | * | 6/1942 | Hurst | 451/532 |
| 2,349,704 | | 5/1944 | Clark . | |
| 2,635,509 | | 4/1953 | Cowie et al. . | |
| 2,740,239 | * | 4/1956 | Ball | 451/536 |
| 2,778,169 | * | 1/1957 | Ball | 451/531 |
| 2,958,593 | * | 11/1960 | Hoover | 451/532 |

(List continued on next page.)

OTHER PUBLICATIONS

Paper, vol. 186, No. 6, Sep. 20, 1976, pp 351–355.

Tappi Journal, 3/88, pp 125–128.

Pleines, H.D., Conference, Coating for the '80s, Nov. 19, 1980 & Nov. 20, 1980.

R. Grant, Advances in Coating, PPI, vol. 25, No. 4, 4/83, p 43.

Glanzburstung Auf Grossen Moschinen, Der Papiermacher, pp. 123–125.

Brush Polishing of Board and Paper, Paper, vol. 192, No. 4, 8/79, pp 167, 172.

Smoothness and Glossiness on Coated Papers from *Coating of Paper and Cardboard* by H. Kotte pp. 380–382 Apr. 1973.

"DOX Brush Finishing System" from *Papier* vol. 43, No. 9, Sep. 1989 p. 516 (Anon).

*Primary Examiner*—Brian L. Johnson
*Assistant Examiner*—Matthew Luby
(74) *Attorney, Agent, or Firm*—Birch, Stewart, Kolasch & Birch, LLP

(57) ABSTRACT

A polishing belt is made from a woven base layer with a matte affixed thereon. The matte includes a plurality of batting fibers with abrasives. These abrasives are permanently mounted on the batting fibers. The abrasives can include abrasive particles impregnated or securely bonded to the shafts of the fibers. Alternatively, wool fibers can be used. These wool fibers can have spaced ridges along the shafts of the fibers. Otherwise, edges of the fibers themselves can be used as an abrasive. The fibers with such edges can have a triangular or star shape in cross section whereby the edges are formed. These edges will act as the abrasive. With this belt, it is possible to polish paper. The paper is passed by the polishing belt. The paper will move at a first speed and the polishing belt will move at a different second speed. The abrasives on the fibers of the polishing belt will abrade the surface of the paper. These abrasives are maintained on the batting fibers during contact with the paper to avoid contamination of the paper with the abrasives.

5 Claims, 5 Drawing Sheets

U.S. PATENT DOCUMENTS

| | | | | |
|---|---|---|---|---|
| 2,984,052 | * | 5/1961 | Mueller | 451/536 |
| 3,147,575 | * | 9/1964 | Schnabel | 451/532 |
| 3,260,582 | * | 7/1966 | Zimmer | 451/532 |
| 3,262,235 | * | 7/1966 | Fulkerson | 451/532 |
| 3,428,517 | | 2/1969 | Grupe et al. . | |
| 3,592,732 | | 7/1971 | Wand . | |
| 3,688,453 | | 9/1972 | Legacy et al. . | |
| 3,862,522 | * | 1/1975 | Mednick . | |
| 4,089,738 | | 5/1978 | Kankaanpaa . | |
| 4,219,383 | | 8/1980 | Valkama . | |
| 4,283,454 | * | 8/1981 | Buchanan . | |
| 4,331,453 | * | 5/1982 | Dau . | |
| 4,349,498 | * | 9/1982 | Stelck | 428/399 |
| 4,357,386 | | 11/1982 | Luciano et al. . | |
| 4,381,325 | * | 4/1983 | Masuda | 428/91 |
| 4,529,643 | | 7/1985 | Lundström . | |
| 4,552,620 | | 11/1985 | Adams . | |
| 4,569,883 | | 2/1986 | Renjilian . | |
| 4,799,998 | | 1/1989 | Dutt . | |
| 4,841,684 | * | 6/1989 | Hall | 51/400 |
| 5,080,759 | | 1/1992 | Buzby et al. . | |
| 5,109,637 | | 5/1992 | Calafut . | |
| 5,137,601 | | 8/1992 | Hsu . | |
| 5,178,729 | | 1/1993 | Janda . | |
| 5,200,260 | | 4/1993 | Hsu . | |
| 5,213,865 | * | 5/1993 | Yamada | 428/92 |
| 5,251,551 | * | 10/1993 | Abe | 100/153 |
| 5,320,036 | | 6/1994 | Krohn et al. . | |
| 5,346,516 | * | 9/1994 | Alkhas | 51/296 |
| 5,427,638 | | 6/1995 | Goetz et al. . | |
| 5,431,592 | * | 7/1995 | Nakata | 451/296 |
| 5,482,756 | * | 1/1996 | Berger | 428/36.2 |

* cited by examiner

PAPER POLISHING BELT AND METHOD OF POLISHING PAPER

This application is a Continuation-in-part of application Ser. No. 08/263,199, now U.S. Pat. No. 5,533,244, filed Jun. 21, 1994, the entire contents of which are hereby incorporated by reference.

BACKGROUND OF THE INVENTION

1. Field of the Invention

The present invention relates to a method and apparatus for polishing paper. In particular, the method and apparatus utilize a polishing belt and cylinder in order to obtain the desirable properties that mechanical shear action imparts to paper. The polishing belt is made from a woven base layer with a matte affixed thereto. The matte includes a plurality of batting fibers which have abrasive means permanently mounted thereon for polishing a paper surface.

2. Description of the Background Art

To impart mechanical energy to a paper surface, a frictional device is left with only three variables; contact force, sliding distance and the coefficient of friction of the frictional material. This relationship can be expressed as $E_m$=Nud where $E_m$=Mechanical energy, N=Normal or contact force, u=coefficient of friction of the polishing surface and d=sliding distance.

The devices considered to be the prior art are at either end of the spectrum, with respect to contact force and distance. These prior art devices have relatively low coefficients of friction for the frictional surface in most cases.

One prior art example uses brush polishing devices which rely on low contact forces and large slip distances. Surface speed differentials typically approach 15,000 feet per minute (fpm). Brush polishers are limited to material operating speeds of 1,500 fpm by mechanical limitations of the rapidly spinning brushes and bristle performance.

Such brush polishers usually have a bristle diameter which is large enough to easily create visible brush marks. Also, the amount of polishing effectiveness of the brush bristles is limited because the bristles cannot be compressed against the sheet of paper. The tips of the bristles do the majority of the polishing work. These tips have a small number of microscopic edges per unit area of polishing material surface thereby limiting effectiveness. Also, the diameter/circumference of the cylinder on which the bristles are mounted is limited thereby limiting a width of the paper to be treated.

One prior art device disclosed in U.S. Pat. No. 4,089,738 to Kankaanpaa also describes stationary devices which drag hard surfaces against paper with higher contact forces compared to brush polishers. The slipping distances between differentials used in these relatively stationary devices are essentially directly related to web speed. Stationary frictional devices as described by Kankaanpaa generate tremendous heat and wear requiring the frictional surfaces to be made of steel or ceramic with relatively low coefficients of friction. The potential for scratching or the chance for developing a machine direction character on the paper is high because there is little opportunity to clean the device during operation, the polishing surface is very hard and the speed differentials are still relatively high (2,500 to 5,000 fpm). Also, this device is designed for polishing uncoated paper. The disadvantages with this approach and other burnishing processes with steel or ceramic include the inflexibility of the hard polishing surface which makes high contact force necessary to achieve the desired results. The high contact force results in high wear, high heat generation and a high probability of marketing/scratching of the product.

An invention described in U.S. Pat. No. 2,349,704 to Clark uses soft rollers with a polishing powder to develop a high coefficient of friction between the paper and the frictional device. This relatively high coefficient of friction device along with relatively high speed differentials results in micro-scratching with presumably low contact forces. Also, the polishing powder is not securely bonded to the soft rollers. Therefore, the polishing powder will contaminate the paper product. To avoid this drawback, the efficiency and operating speed of the device is limited, but contamination can still occur.

SUMMARY OF THE INVENTION

Accordingly, it is a primary object of the present invention to exploit the middle ground in imparting mechanical energy to paper via friction and to use a cost effective polishing material by modifying a product already economically and routinely produced in the paper industry.

It is another object of the present invention to provide a wear surface of the polishing material which can be extended to large distances resulting in a large quantity of material being available for wear.

It is yet another object of the present invention to provide a belt device which can develop sufficient belt tension to produce a polishing pressure of 1 to 30 psi.

It is a further object of the present invention to provide a belt which can wrap a cylindrical backing roll to give an extended contact/working length which increases the dwell time of the paper while it is being worked on by the belt.

Another object of the present invention is to provide extended working lengths which allow for the use of relatively small speed differentials between the paper and the belt.

It is yet another object of the present invention to provide extended working lengths of a belt device which allow for higher machine speeds compared to rotary brushes or roll polishing devices.

It is still another object of the present invention to provide a belt device having a very large percentage of its length available for cleaning, conditioning and static control when not working on the paper.

It is another object of the present invention to provide a frictional type paper polishing device which is able to efficiently dissipate heat produced during the polishing process.

Yet a further object of the present invention is to provide a fabric for the polishing belt which has small diameter fibers which will greatly reduce or eliminate visible markings on the polished paper.

Still another object of the present invention is to provide a belt which can be tensioned in such a way that contact pressure of 20 psi or more can be generated giving the belt the ability to do more work on the material than conventional brush polishers.

Another object of the present invention is to provide a polishing belt with a large number of microscopic edges per unit area of polishing surface in order to increase the effectiveness for polishing fabric.

Still another object of the present invention is to provide a polishing belt with abrasives which are securely bonded to the fiber to thereby reduce potential product contamination.

It is a further object of the present invention to provide a polishing belt which does not require high contact force which results in high wear, high heat generation and possible marking/scratching of the paper surface.

These and other objects of the present invention are fulfilled by a polishing belt which has a base layer woven to form a continuous belt. A matte is affixed on the base layer. This matte includes a plurality of batting fibers. Abrasive means are permanently mounted on the batting fibers. These abrasive means will polish the surface of the paper.

These and other objects of the present invention are also fulfilled by a method comprising the steps of feeding a length of paper at a first speed around a portion of a cylindrical roll. A polishing belt is then pressed against a length of the paper at a second speed. The paper will be between the polishing belt and the cylindrical roll. The first speed of the paper feed is different than the second speed of the polishing belt. The paper will be polished by the polishing belt. This paper moves relative to the polishing belt during the step of polishing. The polishing belt has a base layer and a matte affixed on the base layer. The matte includes the plurality of batting fibers which have abrasives permanently mounted thereon. The step of polishing includes abrading the surface of the paper with the abrasives on the batting fiber. These abrasives are maintained on the batting fiber to thereby avoid contamination of the paper with the abrasives.

Moreover, these and other objects are fulfilled by a method for polishing paper comprising the steps of contacting a length of paper with the polishing belt and moving the paper relative to the polishing belt. The polishing belt has a base layer and a matte affixed on the base layer. The matte includes a plurality of batting fibers with abrasives permanently mounted thereon. This method includes the step of maintaining the abrasives on the batting fibers during the step of abrading to avoid contamination of the paper with the abrasives.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
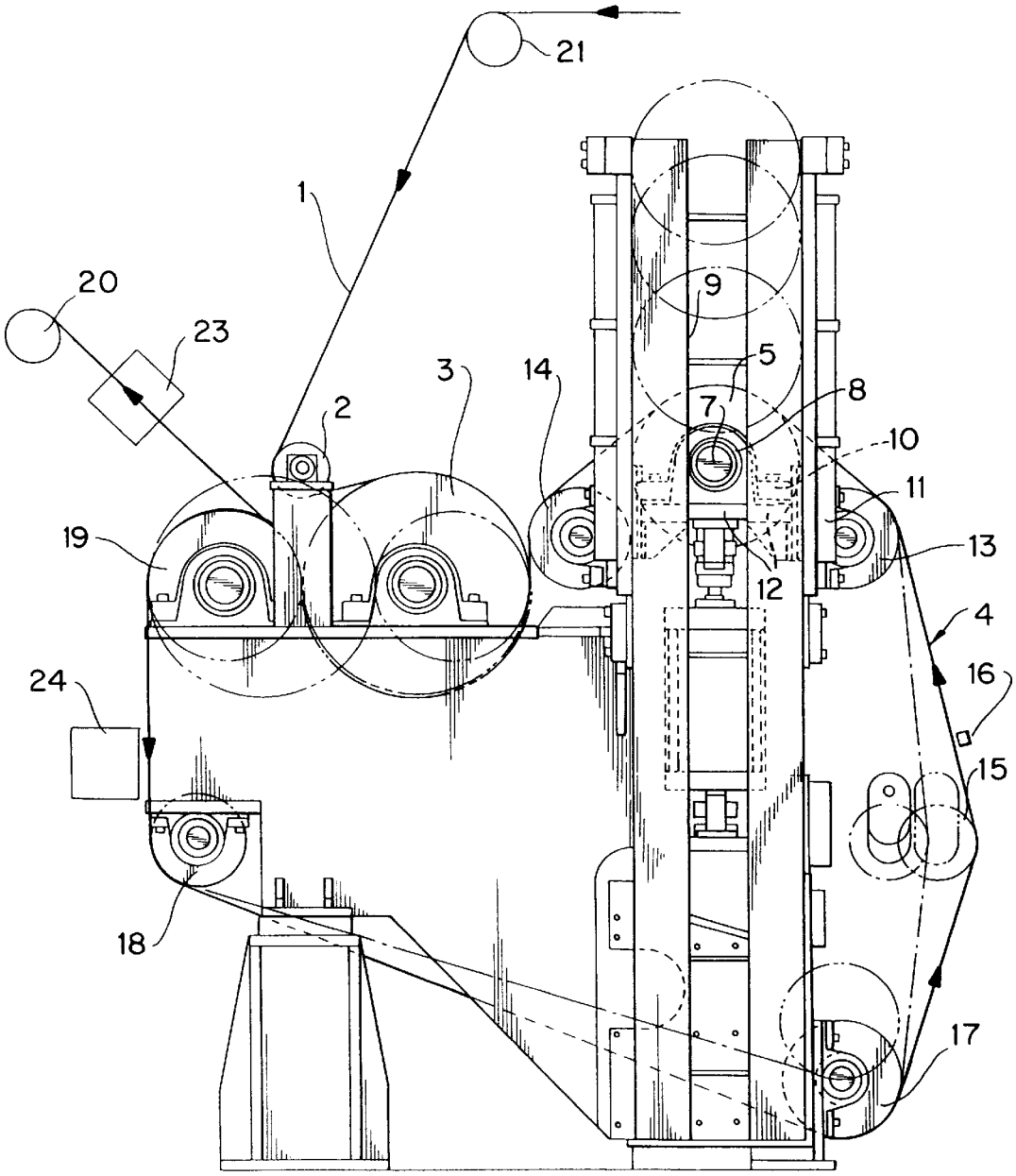
FIG. 1 is a side elevation view of the apparatus of the present invention.
Figure 2:
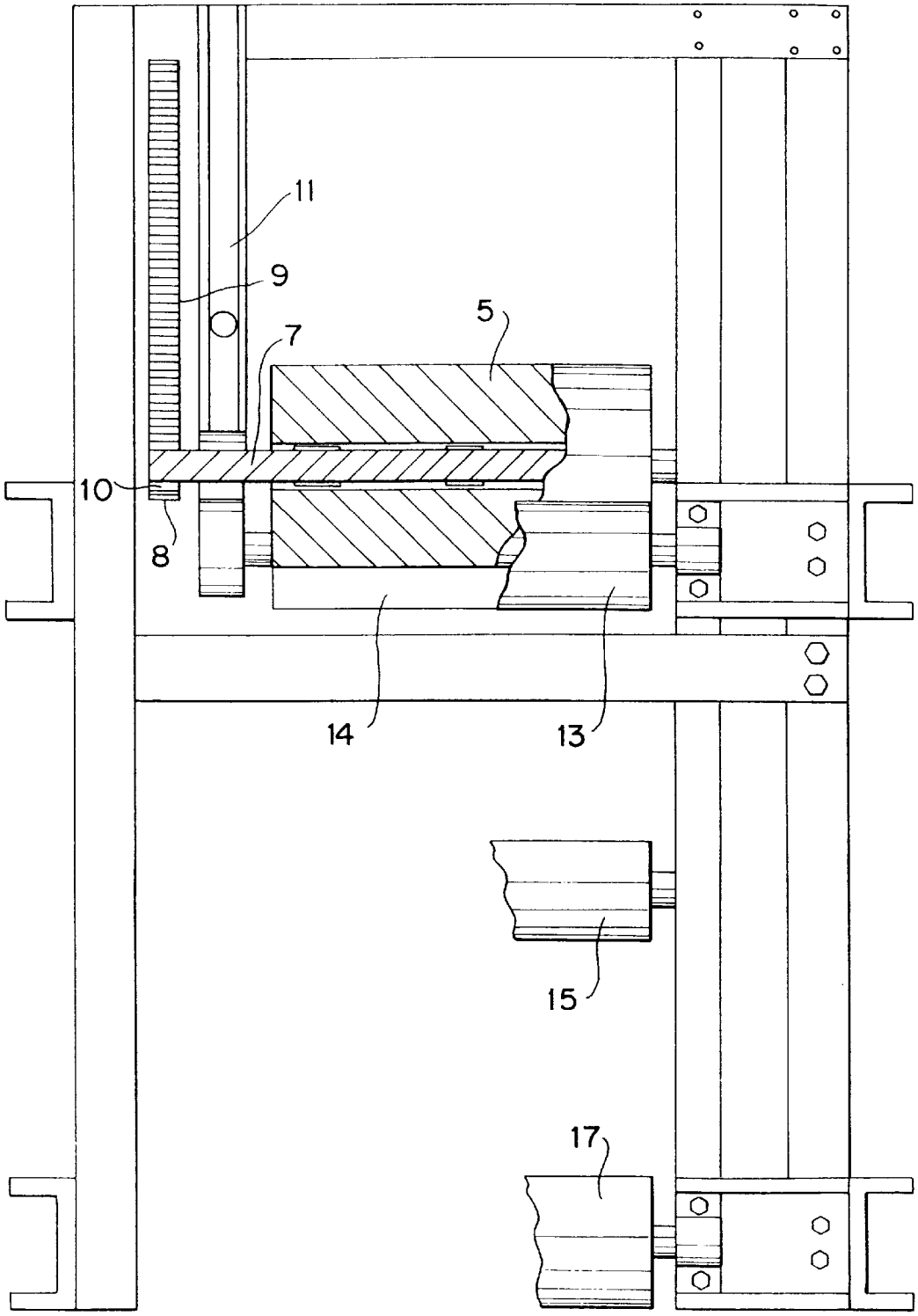
FIG. 2 is a partial section view of the present invention cut along the line 2—2 as shown in FIG. 3.
Figure 3:
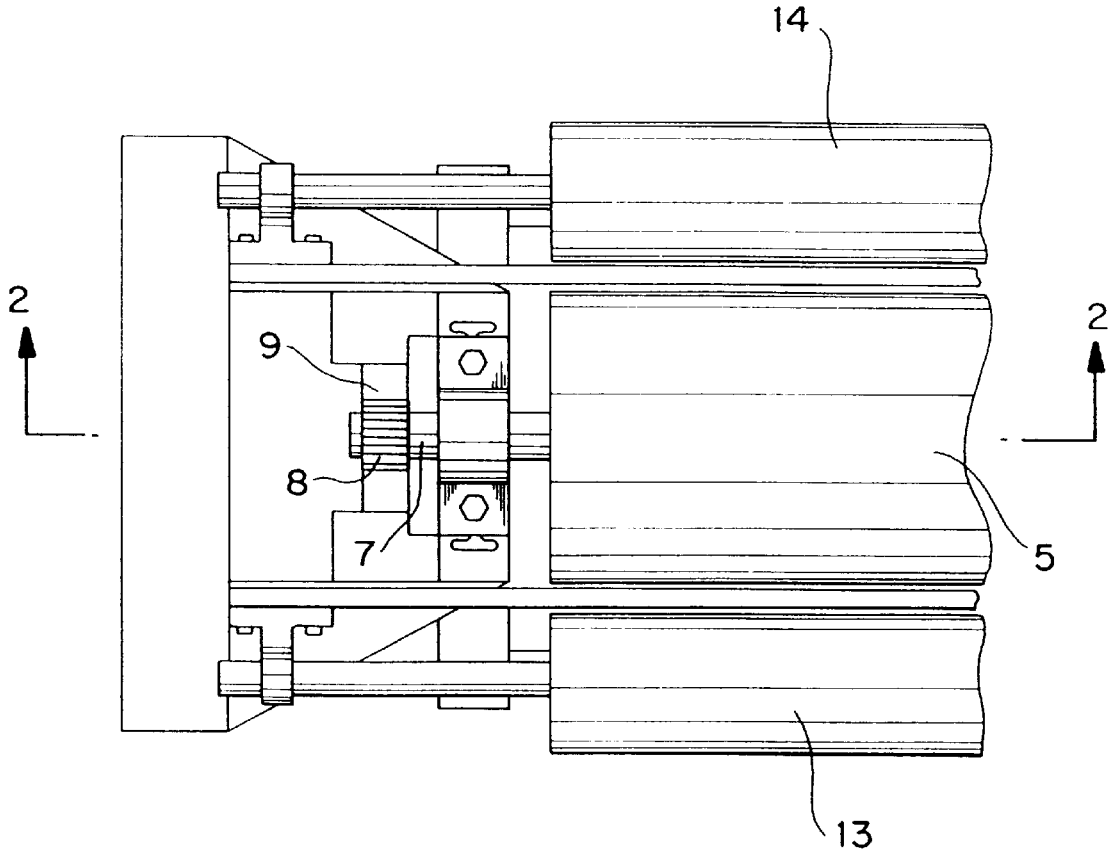
FIG. 3 is a partial top view of the present invention.

Referring in detail to FIGS. 1–3 and with particular reference to FIG. 1, a woven belt paper polisher arrangement is shown, according to the present invention.

The arrangement has a paper sheet 1 which contacts a carrying roll 2 before wrapping around a cylindrical polishing shear inducing roll 3. The cylindrical shear inducing roll 3 is covered with a polyurethane layer to prevent slippage of the paper sheet 1 while in contact with the cylindrical shear inducing roll 3. This material may be made of rubber, urethane, or other synthetic polymer materials that offer high coefficient of friction, flexibility, resiliency and resist "glazing" or loss of coefficient of friction through mechanical friction. As the paper sheet 1 rotates with and at the same speed as the shear inducing roll 3, a polishing belt 4 is brought into contact with the side of the paper sheet 1 to be polished.

The polishing belt 4 is in the general form of a paper machine press fabric with a woven underlayer to maintain the fabric's integrity under high tensions (greater than 200 pounds per linear inch or pli). The woven underlayer is impregnated with a dense batting of natural, synthetic, or metallic fibers or filaments which act as the polishing medium as will be described in detail below. Polishing is carried out by sandwiching the paper sheet 1 between the shear inducing roll 3 and the polishing belt 4. If the polishing belt 4 is driven at a different speed relative to the paper sheet 1, the polishing belt 4 will preferentially slip against the sheet 1 while wrapped around the shear inducing roll 3 since the coefficient of friction is lower for the surfaces of the polishing belt 4 and the paper sheet 1, as compared to the surfaces of the rubber coated shear inducing roll 3 and the paper sheet 1 at any normal force applied to the shearing inducing roll 3 by the tension of the polishing belt 4.

The tension is developed in the polishing belt 4 by the extension of the tensioning roll 5 to increase the length of the belt path. Four different tensioning roll positions are also shown in FIG. 1. The tensioning roll 5 is moved by two pneumatic or hydraulic pistons 6 at both ends of the tensioning roll axle 7. The tensioning roll 5 is a "dead shaft" roll allowing it to freely rotate about the tensioning roll axle 7. The position of roll 5 is controlled in the "z" axis by maintaining equal pressure on both pistons 6 during operation. A pair of pinion gears 8 and toothed racks 9 are provided at each end of the tensioning roll axle 7. The gears 8 and racks 9 maintain the alignment of the tensioning roll 5 in the vertical plane with respect to the shear inducing roll 3. The horizontal position of the tensioning roll 5 is controlled by guiding each bearing block 10 between a pair of guide rails 11 that are mated to the bearing block mounting bracket 12 by means of "T" slots that couple the roll 5 to the mounting bracket 12 while allowing the bracket 12 to move only in the vertical plane.

Two idler rolls 13, 14 are positioned on bearing blocks 10 to maintain the same resultant tension on both the ingoing and outgoing side of the belt tensioning roll 5 to prevent the tensioning roll 5 from binding in the guide rails 11. A belt guiding device 15 is used to keep the polishing belt 4 centered with respect to the shear inducing roll 3. The belt guiding device 15 pivots around the midpoint of the roll face in a plane substantially parallel to the polishing belt 4. Two different operating positions are shown in FIG. 1. The belt position is determined with a sensor 16 and the polishing belt 14 is then automatically directed by pivoting roll 15 to steer the belt 4 back in the proper position. The speed of the polishing belt 4 is controlled by regulating the speed of roll 19 with electric drives or mechanical brakes. This roll 19 should be covered with a rubber-like surface or high friction surface to prevent slippage with respect to the polishing belt 4.

The polishing belt carrying rolls 14, 5, 13, 15, 17, 18 and 19 and the shear inducing roll 3 must be sufficiently stiff to prevent deflection under belt tensions of up to 250 pli. The speed of the paper sheet 1 is controlled by driving the shear inducing roll 3 independently of roll 19 that drives the polishing belt 4. Rolls 20,21 carry the sheet and are not driven.

Devices to clean the paper sheet 1 and remove static electricity may be installed as shown by reference numeral 23. Devices to clean and remove static from the polishing belt 4 may be installed as shown by reference numeral 24. Of course, the exact positioning of either cleaning device 23 or 24 could be moved from the illustrated position. It is simply necessary for these devices 23, 24 to be adjacent to the paper sheet 1 and belt 4, respectively at some point. Both the cleaning and static devices are commercially available.

These static and cleaning devices may use the following or a combination of the following to clean the web or paper: ionized air jets, brushes, vibration, ion emitters.

The belt may also be cleaned with sprays of cleaning water or solvents if means for drying the belt are used after application.

The polishing device of the present invention is designed to provide for a wide range of polishing pressures against the shear inducing roll 3 and a wide range of speed differentials between the paper sheet 1 and the polishing belt 4.

The use of a belt to impart frictional energy to paper is advantageous because of at least the following reasons. First, the wear surface of the polishing material of the polishing belt 4 can be extended to large distances around the cylindrical polishing backup/shear inducing roll 3 which results in a large quantity of material available for wear. Inherently, such a belt 4 would take longer to wear and the life of the belt would be prolonged. Further, the polishing belt 4 can wrap around the shear inducing roll 3 extending the contact/working length and thereby increasing the dwell time of the paper while it is being worked on by the polishing belt. The above described extended working lengths also allow for the use of relatively small speed differentials between the paper sheet 1 and the polishing belt 4. These small speed differentials reduce the chances for developing a machine direction character in the paper by scratching or dragmarks. Lab scaled trials indicate that drag distances of 2 inches to 15 inches should be suitable to create the desired results. This length is less than the length for a rotary brush or roller arrangement operating at a web speed of 1,500 fpm which would require 16 inches to 26 feet of brush or roller contact length to produce similar results achieved by the present belt method.

The extended working lengths of a belt device according to the present invention also allow for higher machine speeds compared to rotary brushes or roll polishing devices. For the device of the present invention, operational paper speeds are approximately 2,500 to 3,500 feet per minute with polishing belt speeds of 1,500 to 3,200 feet per minute. In contrast, rotary brush or roll polishers are limited to operating paper speeds of less than 1,500 feet per minute with roll or brush speeds of 3,000 to 15,000 feet per minute.

As described previously, a belt device has a very large percentage of its length available for cleaning, conditioning and static control when not working on the paper. In contrast, a roll device has a very limited "not in use" fraction of its circumferential length available for reconditioning or cleaning.

Furthermore, permeable belts can be cleaned or treated from both sides and are able to dissipate more heat since there is more time for them to cool when they are not working on the paper compared to a rotary cylinder device. These factors reduce belt wear and keep maintenance costs low.

Using a paper machine press felt belt, similar to but modified for effective polishing with a woven underlayer and a batted top layer to impart mechanical energy to a paper sheet by means of friction, is advantageous because paper machine fabrics of this type are designed and manufactured to operate on machines in the same lengths and widths that would be considered optimal for a large commercial scale paper polisher. These fabrics are designed to withstand tensions of 500 to 1,200 pli before breaking. The operating tensions of the present device are estimated to be between 50 and 300 pli. Operating tensions of these fabrics greater than 80 pli and up to 300 pli have been demonstrated for the first time in developing this machine and process. However, normal operating tensions for these fabrics are generally about 20 pli and in rare cases as high as 60 pli to 80 pli.

Because a polishing belt 4 is used, this will allow or larger diameter cylinders to be utilized to create larger working surface which exceeds what can be achieved with currently manufactured rotary brushes. By extending the working surface, a fabric polishing device is allowed to run with smaller speed differentials with respect to the polishing stock compared to brush bristle type polishers which will also increase the amount of work delivered to the material being polished as noted above.

Figure 4:
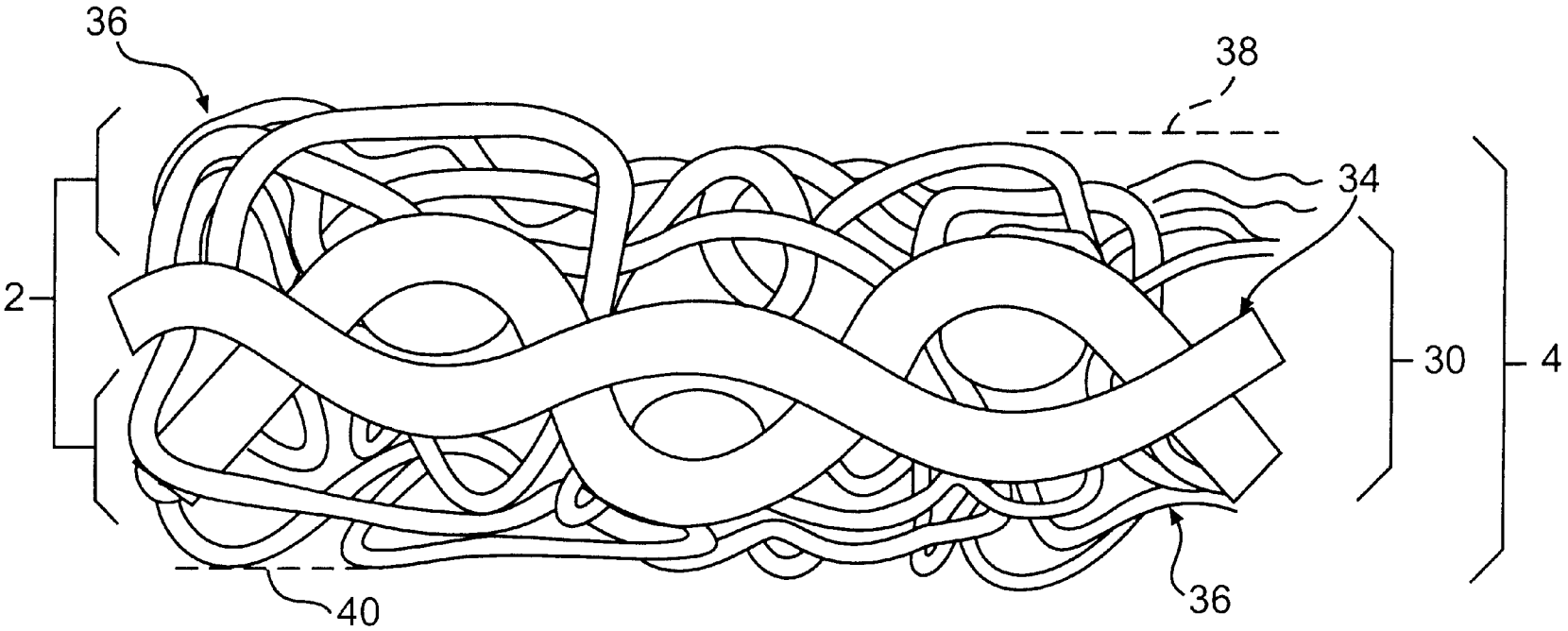
FIG. 4 is a cross-sectional view from the side showing a magnified portion of the polishing belt of the present invention.

Turning now to FIG. 4, an enlarged cross section of a portion of belt 4 is shown. This belt is made up of two components, a woven base layer 30 and a matte 32. The woven base layer 30 is made up of monofilament or multifilament batting fibers 34. This base layer 30 is like a scrim. These fibers 34 are woven together to form a continuous belt or loop of various widths and lengths. This weaving process is typically done on a loom. The weave pattern can be of various designs but should allow for high air permeability, high operating tensions of 200 pli or more and limited stretching elongation of 10% or less under operating tension. The woven base layer 30 should also readily accommodate and securely hold a fibrous nonwoven matte 32 made up of batting fibers 36. These batting fibers are needled into the woven base layer 30. The fibers 34 of the base layer 30 can be made of nylon or other suitable fibers that have the above-mentioned properties.

The stapled batting fibers 36 are formed into a nonwoven matte 32 by carding or other forming processes. These batting fibers 36 should have the proper cut length. This cut length is typically 1–4 inches. The diameter of fibers 4 should allow the fibers to be securely and durably needle punched into the woven base layer 30.

Figure 5:
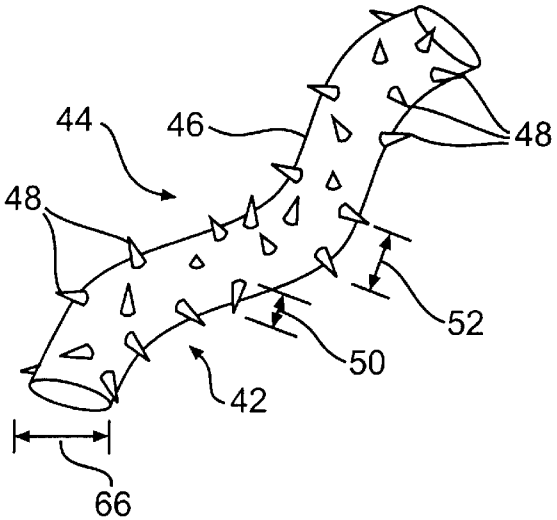
FIG. 5 is an enlarged perspective side view of a section of a first embodiment of a batting fiber used in the polishing belt of the present invention.

As indicated by arrow 66 in FIG. 5, the diameter can be 20 $\mu$m. While the diameter 66 of a first fiber embodiment 44 in FIG. 5 is shown as being generally uniform, it should be appreciated that this diameter can be somewhat uneven. In other words, the shaft 46 of fiber 44 can be of rough character on a microscopic scale.

A layer or layers of nonwoven matte 32 should be installed to create a flat surface 38, 40 with uniform density. While the woven base layer 30 is shown with both upper and lower flat surfaces 38, 40, it should be appreciated that only one side of the base layer 30 can have a plurality of fibers 36 needled thereinto if so desired. In other words, only one flat surface 38 or 40 could be formed if so desired. These flat surfaces 38 and 40 are accomplished with a combination of needling style and compaction with rollers.

The batting fibers 36 should have diameters of less than 40 $\mu$m. The range of lengths of the batting fibers 36 should be from 2–3 inches. The batting layer or matte 32 is made of the batting fibers 36 having shafts of uneven or rough character on a microscopic scale. The roughness on the outside of the fiber shafts 36 should be on the same scale as the paper coating particles subject to polishing. In the case of clay platelet having a size of 0.5 $\mu$m to 2 $\mu$m in cross section, the roughness at the edges attached to the fiber shafts should be approximately 0.5 to 3 $\mu$m and 1.0 to 20 $\mu$m between adjacent edges or a given fiber shaft.

In other words, the batting fibers 36 will have abrasive means 42. This abrasive means 42 can vary depending upon the embodiment of fiber used. For example, in FIG. 5, the first embodiment 44 of the batting fiber 36 is shown. This fiber 44 has a fiber shaft 46. Abrasive particles 48 are impregnated or securely bonded to the fiber shaft 46. These fibers 44 are formed into a nonwoven matte or mattes 32 and needled into the woven base layer 30 to produce a polishing belt. Examples of the types of particles 48 which can be used on synthetic fiber 44 include tin oxide, aluminum oxide, carbide, carbon, silicon dioxide, titanium dioxide and nickel carbonyl ($Ni(CO)_4$).

It will be noted that the height of the abrasive particles 48 is indicated in FIG. 5 by arrows 50. That is, the distance from the outer edge of the abrasive particles 48 to the surface of the fiber shaft 46 is indicated by arrows 50. This distance is 2 $\mu$m. The height can be approximately in the range of 0.5–10 $\mu$m when the platelet particles have a size of 0.5 $\mu$m to 2 $\mu$m in cross section. A distance between adjacent particles can be 1.0–20 $\mu$m as indicated by arrow 52.

Figure 6:
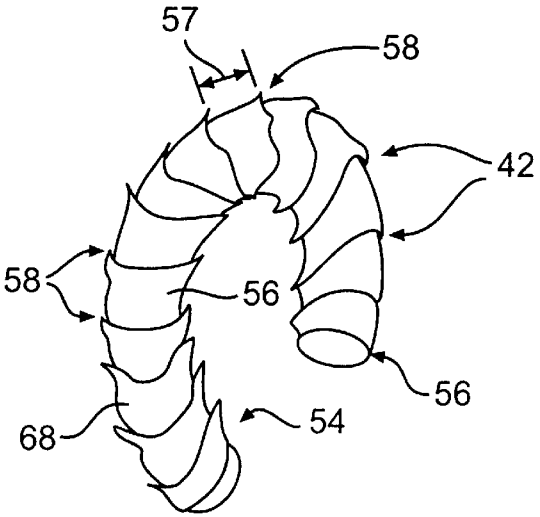
FIG. 6 is an enlarged perspective side view of a section of a second embodiment of a batting fiber used in the polishing belt of the present invention.

Turning now to FIG. 6, a second fiber embodiment 54 is shown. To create a roughened character on the batting fibers 54, a blend of wool fibers and cylindrical smooth nylon fibers made be needle punched into the woven base layer 30. The wool content in the matte 3 is greater than 50%. The shaft 56 of fiber 54 has a plurality of ridges 58 formed thereon. The abrasive means 42 in this FIG. 6 embodiment comprises the raised ridges 58. Each of these ridges has an outer edge spaced from the shaft 56. The ridges 58 encircle the fiber shaft 56. Adjacent ridges 56 are positioned a predetermined distance 57 from one another. When the fiber 54 is straight, this distance 57 can be 10 $\mu$m. The distance 57 should be within the range of 1.0–20 $\mu$m. The height of the outer edge of the ridges 58 should be approximately 0.5–3 $\mu$m.

Figure 7:
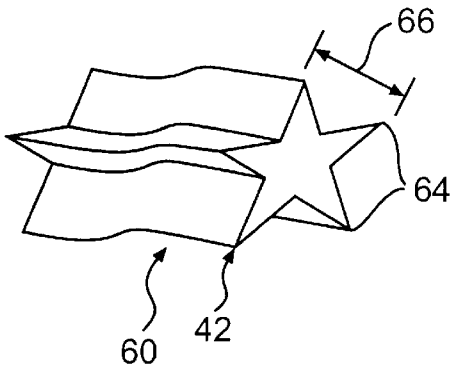
FIG. 7 is an enlarged perspective side view of a third embodiment of a batting fiber used in the polishing belt of the present invention.
Figure 8:
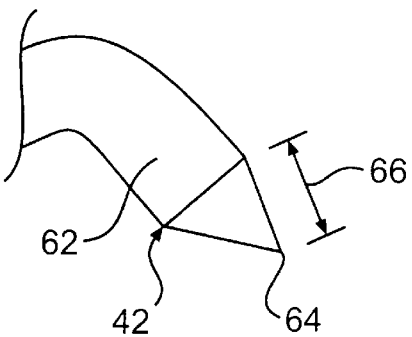
FIG. 8 is an enlarged perspective side view of a fourth embodiment of a batting fiber used in the polishing belt of the present invention.

Turning now to FIGS. 7 and 8, a third fiber embodiment 60 and a fourth fiber embodiment 62, respectively, are shown. These fibers 60 and 62 operate in basically the same way except that the third fiber embodiment 60 has a star shaped cross section while the fourth fiber embodiment 62 has a triangular cross section. While the triangular cross section shown in FIG. 8 is generally an equilateral triangle, it should be appreciated that any shape triangle can be used. Moreover, it should be appreciated that different shapes for the fibers can be used. It is merely necessary that abrading edges 64 are formed on the fibers. The distance between these edges is 10 $\mu$m as indicated by arrow 66 in FIGS. 7 and 8. This distance, however, merely needs to be in the range of 1.0 to 20 $\mu$m.

The abrading edges 64 form the abrasive means 42 in the third and fourth embodiments of FIGS. 7 and 8. These edges 64 extend along a length of the batting fibers 60, 62. While these edges are shown as being continuous, it should be appreciated that they can be broken along a portion of the length thereof. These fibers 60, 62 can be made from nylon with the abrading edges 64 being about 10 $\mu$m apart as noted above. The fibers 60, 62 can also be carded into the nonwoven matte 32 and needled into the base layer 30 producing the polishing belt 4.

In FIG. 5, the diameter of the fiber shaft 46 is indicated by arrow 66. This diameter is 20 $\mu$m. A similar diameter can be had for the second embodiment fiber shaft 56 of the fiber 54. This diameter of 20 $\mu$m for the fiber 54 can either be measured in the valleys 68 between ridges 58 or at the outer edges of these ridges 58.

The abrasive means 42 therefore comprises the abrasive particles 48 in the first fiber embodiment 44, the ridges 58 in the second fiber embodiment 54 and the edges 64 in the third 60 and fourth 62 fiber embodiments, respectively. This abrasive means or abrasive is strong, abrasion resistant and flexible. It will allow for frictional and complete conforming contact with an uneven surface found on many materials such as paper.

In the case of the clay platelet of a size 0.4 $\mu$m to 2 $\mu$m in cross section, the roughness at the edges of the abrasive means 42 from the fiber shafts is approximately 0.5–10 $\mu$m and approximately 1.0–20 $\mu$m between adjacent edges or points on a given fiber shaft. With the instant polishing belt, extended working distances can be had. A sufficient contact pressure (10–20 psi) can be obtained by wrapping the belt around cylinders designed to carry and hold paper that is to be worked on by the polishing belt 4. This working distance is created by tensions of approximately 200 pli for a 20 inch diameter cylinder. The woven base layer 30 of the polishing fabric provides this structural requirement.

The batting fibers 36 are carded are otherwise formed into nonwoven matte 32 and then needled into the woven base layer. These fibers are designed to securely carry the microscopic abrasive particles/edges while allowing the contact surface to be deformable so complete contact can be made with microscopic particles distributed on surfaces with large scale surface variations such as paper. The flexibility of the fiber batting 36 also allows the overall coefficient of friction to be lowered so that the belt will preferably slip against the paper while the paper is being held by a higher coefficient of friction surface such as polyurethane rubber. It has been found that if a fiber shaft with microscopic edges on the scale of 0.5 to 5 $\mu$m in amplitude is brought into contact under shear with the paper surface coated with platelet particles, these fibers edges or irregularities work to align clay or other platelet particles very effectively.

With any polishing material, wear will occur. The use of a polishing belt 4 can be made in wide widths such as 300 feet and extensive lengths such as 400 feet. These dimensions allow the wear surface to be spread out over a large amount of polishing material. Wear is also minimized by using hard abrasive particles or fiber edges to align the platelet particles on the polishing material. These platelet particles dispersed in a latex or similar binder flow under shear with relatively little force compared to other nonplatelet like particles. The selective nature of the fibrous edges allows the polishing energy/force to be targeted towards the platelet particles which have the least resistance to shear thereby minimizing the wear of the polishing belt 4.

Wear is further minimized by allowing the abrasive edges or points to adjust to larger scale surface irregularities by attaching these edges or particles to flexible fibers 36. This flexibility/conformability of fibrous mattes allow for relatively low contact pressures, such as 11–16 psi. While low contact pressures are achieved, a uniform polishing effect and reduces wear will also be obtained.

The polishing belt 4 creates a uniform contact pressure on a macroscopic scale by needle punching the fiber matte 32 to a woven base layer 30 which will stretch and relieve itself under tension to produce a uniform contact pressure against the material to be polished and the cylindrical surface the fabrics are wrapped around. Markings that typically occur with shearing action applied to a dry paper surfaces are minimized or eliminated by using microscopic edges to transmit the shear force to the paper or material surface and by attaching these abrasive edges to fibers that have relatively small diameters (25 $\mu$m, for example). Such a size is nearly invisible to the naked eye. Edges that are small enough to be invisible to the naked eye will result in polishing marks that are also invisible to the naked eye. Because the fibers 36 are softer than steel or ceramic surfaces of conventional rollers or plates, a more uniform effect on the paper can advantageously be obtained while reducing contact pressure and preventing scratching as noted above.

The tensile strength of the woven polishing belt 4 allows a moderate contact force/pressure to be developed against the paper and cylindrical backup roll. The contact pressure needed for optimal polishing is estimated to be between 1 and 30 psi developed against the cylindrical shear inducing roll 3.

With the present invention, a polishing belt for polishing of articles, namely paper, is obtained. The base layer 30 is woven to form the continuous belt 4. Affixed on the base layer is matte 32 made up of batting fibers 36. Abrasive means 42 are permanently mounted on these fibers 36 for polishing the surface of the article.

Apart from this belt, the instant invention discloses a method for polishing the paper. This method includes feeding a length of paper at a first speed around a portion of a cylindrical roll. The polishing belt 4 is passed against the length of the paper at a second speed. The first and second speeds are different. The paper is polished with a polishing belt 4 when the paper is in contact with the polishing belt during the step of passing. The paper moves relative to the polishing belt during the step of polishing. The polishing belt 4 has a base layer 30 and a matte 32 affixed on the base layer 30. The matte 32 includes batting fibers 36 with abrasives 42 permanently mounted thereon. The step of polishing further includes the step of abrading the surface of the paper with the abrasives 42 and maintaining the abrasives 42 on the batting fiber 36 in order to avoid contamination of the paper.

The method also comprises the steps of polishing paper by contacting a length of paper with the polishing belt 4. The polishing belt 4 has a base layer 30, a matte 32 with a plurality of batting fibers 34. The paper is moved relative to the polishing belt. A surface of the paper is abraded with the abrasives 42 mounted on the batting fibers 36. The abrasives 42 are maintained on the batting fibers 36 during the step of abrading.

Belts have been tested on a modified lab scale instrument used to measure the coefficient of friction. A larger lab scale device using higher contact forces with larger polishing areas was also used. Tests were also conducted on 40 inch wide polishing belts. The tests showed the fabric using wool fibers outperforms 30 different fabrics using smooth, round synthetic fibers in the nonwoven fiber matte 32. Paper coatings with higher levels of clay were also found to produce better results with lower wool content belts or rather, with less polishing work.

Scanning electron micrographs showed how the wool fibers aligned clay particles while non-platelet $CaCO_3$ particles were not effected. The scanning electron micrographs also showed wool fibers stripped of their edges also lost their polishing capability.

A pilot size machine was used to test various fabrics performances with respect to operating speed, tension, wear and runability to produce samples large enough for print testing. The instant polishing belt was found to be very satisfactory.

The batting composition for wool press felts was changed to accommodate polishing by reducing the nylon content of the batting to less than 50%. The diameters of these nylon fibers were also reduced to less than 15 denure which is the standard denure for wool/nylon blended batting. This change makes the fiber matte softer and more conformable. The needling and compaction of the matte was adjusted to optimize polishing effectiveness.

Synthetic fibers with cross sections having microscopic edges can be substituted for fibers with round or edgeless cross sections and needled to a similar base layer 30 used for the woolen matte. The needling and compaction of the fabric and fiber diameters can also be adjusted to optimize polishing effectiveness.

This same woven base layer can be used as a base to needle batting with abrasive particles attached to the small diameter batting fibers to create a more durable polishing material. Such fibers have been used in filtration means and woven carpeting but have not been applied to polishing belts.

The invention being thus described, it will be obvious that the same may be varied in many ways. These variations may include multi-stage operation and arrangements to polish both sides of the sheet by repeating this basic operation. Such variations are not to be regarded as a departure from the spirit and scope of the invention, and all such modifications as would be obvious to one skilled in the art are intended to be included within the scope of the following claims.

What is claimed is:

1. A method for polishing paper comprising the steps of:

feeding a length of paper at a first speed around a portion of a cylindrical roll;

passing a polishing belt against a length of the paper at a second speed, the paper being between the polishing belt and the cylindrical roll and the first and second speeds being different; and polishing the paper with the polishing belt when the paper is in contact with the polishing belt during the step of passing, the paper moving relative to the polishing belt during the step of polishing, the polishing belt having a base layer and a matte affixed on the base layer, the matte including a plurality of batting fibers and the batting fibers including abrasives permanently mounted thereon, the step of polishing including the step of, abrading a surface of the paper with the abrasives mounted on the batting fibers, and maintaining the abrasives on the batting fibers during contact with the paper to avoid contamination of the paper with the abrasives.

2. The method of polishing paper as recited in claim 1, wherein the step of polishing comprises the step of using abrasive particles permanently affixed to the batting fibers, the abrasive particles being one of impregnated and securely bonded to shafts of the batting fibers.

3. The method of polishing paper as recited in claim 1, wherein the step of polishing comprises the step of using batting fibers having shafts with a plurality of spaced ridges extending around each shaft, the ridges being spaced from one another by a predetermined distance.

4. The method of polishing paper as recited in claim 1, wherein the step of polishing comprises the step of using batting fibers with a plurality of edges extending along a length thereof, the batting fibers have one of a generally triangular shape and a star shape in cross section.

5. The method of polishing paper as recited in claim 1, further comprising the step of keeping the paper out of contact with itself during the step of polishing.

* * * * *